United States Patent [19]

Montgomery

[11] 4,417,597

[45] Nov. 29, 1983

[54] AWNING STRUCTURE

[76] Inventor: Rodney L. Montgomery, P.O. Box 37194, Winnellie, N.T., Australia

[21] Appl. No.: 179,468

[22] Filed: Aug. 19, 1980

[51] Int. Cl.[3] ..... E04F 10/04

[52] U.S. Cl. ..... 135/102; 135/905

[58] Field of Search ..... 135/1 R, 5 R, DIG. 1, 135/3 R

[56] References Cited

U.S. PATENT DOCUMENTS 3,052,250 9/1962 Moss ..... 135/3 R 3,128,781 4/1964 Kirkham ..... 135/3 R 3,909,993 10/1975 Huddle ..... 135/DIG. 1

*Primary Examiner*—J. Karl Bell

*Attorney, Agent, or Firm*—Larson and Taylor

[57] ABSTRACT

An awning structure is disclosed which comprises a beam formed in two parts and joined by a joiner. The beam is coupled to an awning formed of shade cloth and canvas. The beam is deformed and connected to two poles. The deformation of the beam causes the awning to be placed under tension and the compression of the beam maintains the awning under tension when in use.

8 Claims, 16 Drawing Figures

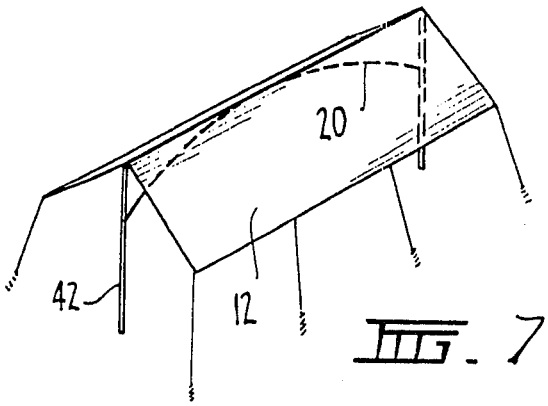
FIG. 7.
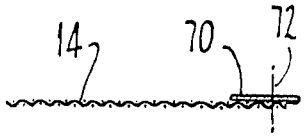
FIG. 10a.
FIG. 10b.
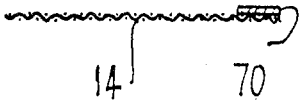
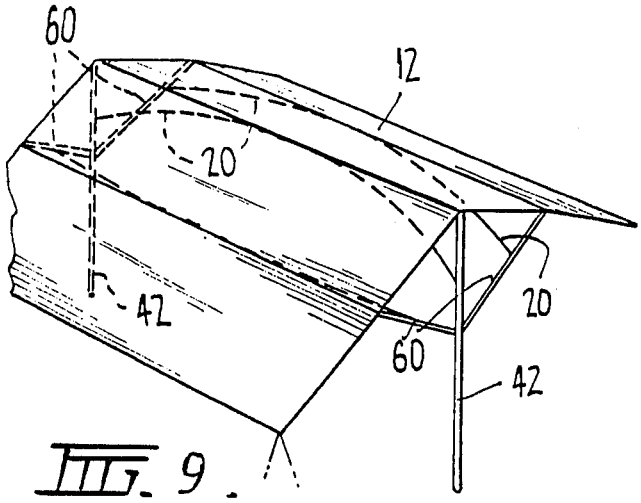
FIG. 9.
FIG. 10c.
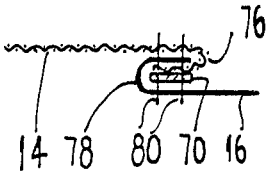
FIG. 10d.
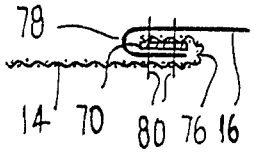
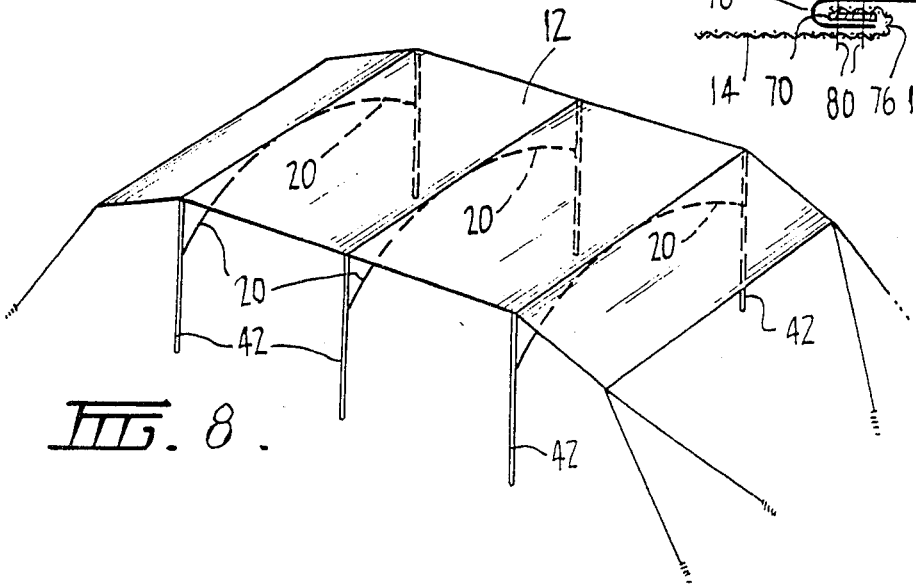
FIG. 8.

AWNING STRUCTURE

This invention relates to an awning structure for providing shelter and shade and also a method of erecting the same.

Awnings for performing these functions are known. However, such awnings are often difficult to erect and also are not particularly stable, particularly when they are large. Further, such awnings may be easily damaged by the weight of water which may collect on them, if they are exposed to rain. In areas which experience continuous sunshine, providing shade is a serious problem. Permanent structures are extremely expensive and not always the answer. Shade may be needed on some occasions and not on others. Thus, it may be desirable to provide an awning which will cover a swimming pool to prevent articles being blown into the water, and which can be moved or removed to allow the sun to heat the water. There is a considerable demand, particularly in the north of Australia, for awning structures which may be used for providing shade and shelter for many purposes.

This invention seeks to provide an awning structure which is stable and easy to erect and capable of withstanding normal weather conditions.

In one aspect, the invention resides in an awning structure for supporting an awning including a resilient beam and tensioning means whereby said resilient beam may be stressed for placing the awning under tension.

Preferably, the beam is stressed by two uprights located one at each end of the beam, which are movable into an upright position to bow the beam and thereby shorten the distance between its ends, the said uprights being used also to support the awning above the ground.

Preferably, the awning is placed under tension by connecting the beam at its mid-section to a mid-section of the awning, connecting the ends of the beam to an intermediate portion of the uprights, and also connecting the awning to the tops of the uprights and deforming the beam into a bowed configuration by drawing the uprights into an upright position which, in turn, extends the awning to place it under tension. The uprights may then be secured to the ground and the resultant structure extremely stable due to stressing of the beam and resultant tensioning of the panel. The uprights act as levers to retain the awning in a taut condition. Preferably, the awning is reinforced along the extent of the beam by a metal strip or other suitable reinforcing material.

In a second aspect, the invention provides an awning structure including an awning, said awning having fixed to it a joiner for receiving the ends of two resilient beams, said awning having means for connecting it to at least two uprights, such that, in use, two beams may be deformed into bowed shapes by inwardly drawing the uprights into substantially vertical positions and at the same time tensioning the awning by drawing it outwardly due to the connection between the awning and the top of the upright.

The invention also resides in an awning formed from a plurality of panels which may be alternating panels of shade cloth, and water resistant material.

The shade cloth preferably shade mesh material and the water resistant material allow air to circulate up through the cover in hot weather thereby cooling the region covered and prevent water from collecting on the cover. The shade mesh is porous to wind and resists the rain. Therefore, the wind is able to pass through the shade mesh thereby reducing the likelihood of the cover collapsing in strong winds.

Also, in the prior art, it has not been possible to join shade mesh such as that sold under the trade mark SARLON to canvas materials. SARLON shade mesh is a fibrous material which is difficult to cut and join to other materials.

The invention also provides a method of joining shade mesh to another material comprising the steps of folding the shade mesh near one edge to provide an overlapping strip, folding the other material near one edge also to provide an overlapping strip, intermeshing the respective overlapping strips of both materials and fastening through the materials and the overlapping strips.

Preferably, the shade mesh is initially provided with a straight edge by applying plastic tape along the material to overlap the edge, which is normally in a rough unravelled state and cutting through the plastic tape and the shade mesh to provide the desired straight edge.

Preferably, the fastening of the materials is effected by sewing.

A preferred embodiment of the invention will be described with reference to the accompanying drawings in which.

Figure 6:
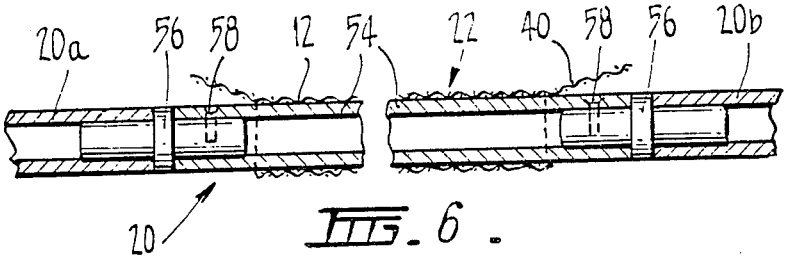
Figure 3A:
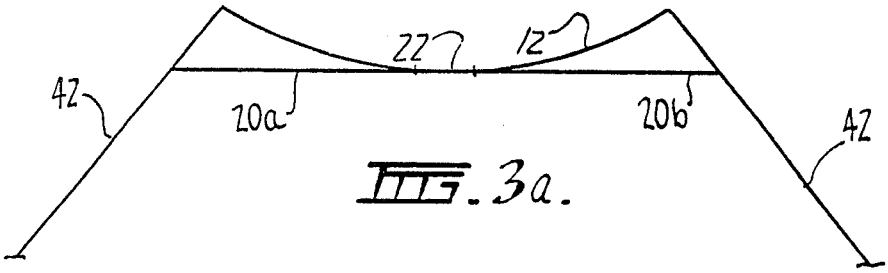
Figure 3B:
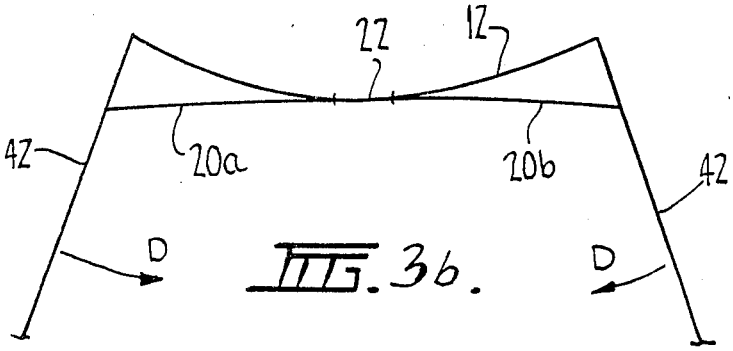
Figure 3C:
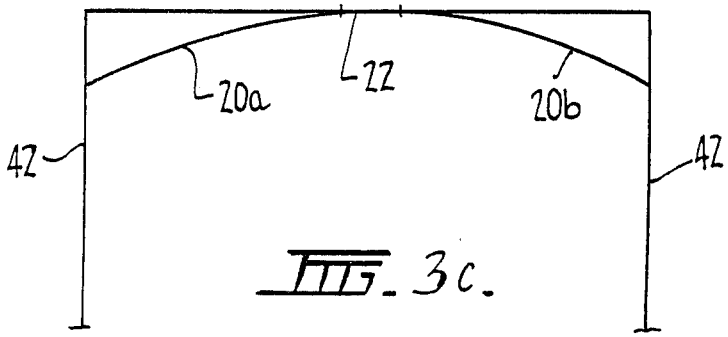
Figure 4:
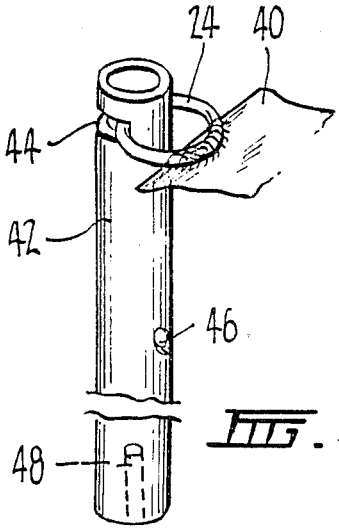
Figure 5A:
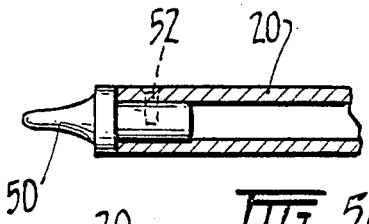
Figure 5B:
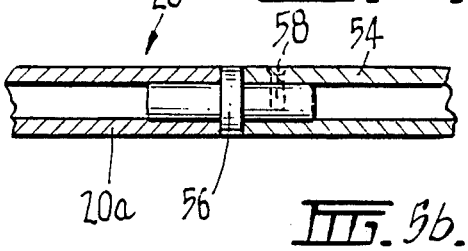

FIGS. 3*a*, 3*b* and 3*c* are views showing the manner in which the awning structure is erected, FIG. 4 is a view of an upright of the awning structure (not to scale), FIGS. 5*a* and 5*b* are views of a beam of the awning structure, FIG. 6 is a view of a beam and joiner piece, FIGS. 7 to 9 are views of various structures of the invention, and FIGS. 10*a* to 10*d* show the method for joining the panels forming the awning.

Figure 1:
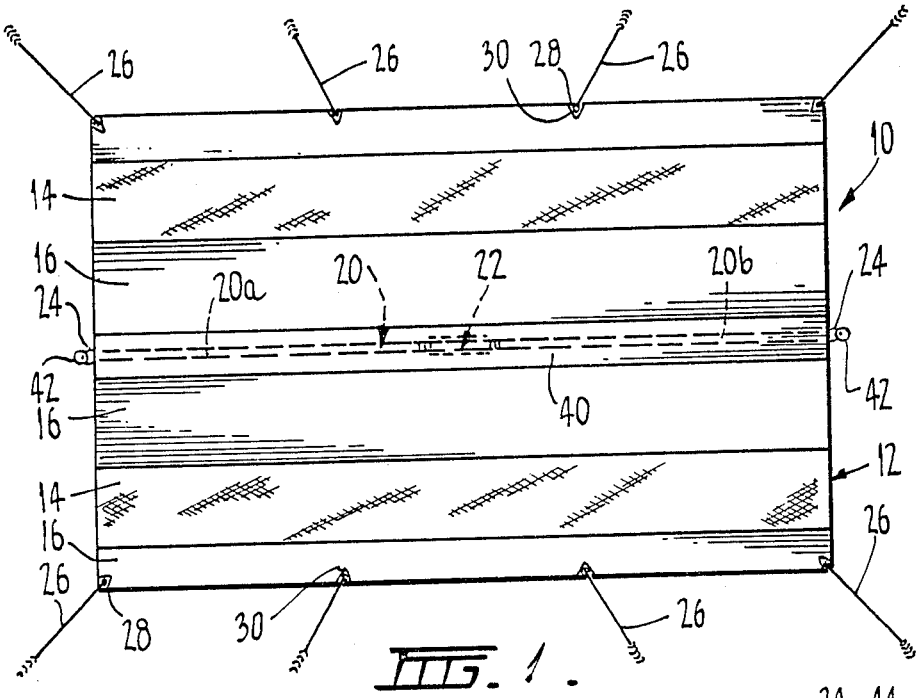
FIG. 1 is a view from above of an awning structure embodying the invention.

Referring firstly to FIG. 1, the awning structure 10 comprises an awning 12 formed in elongate panels with alternate panels being made from shade material 14 such as shade mesh sold under the trade mark SARLON, and a plasticized canvas material 16. The manner of joining the said material will be described in detail hereinafter.

Extending longitudinally below the center of the panel 12 is a resilient beam 20. The beam 20 is preferably formed in two sections 20*a* and 20*b* and is joined by a joiner 22 at midsection of the awning 12. The joiner 22 is fixed to the panel 12. The panel 12 also has a reinforced section 40 which extends along the vicinity of the awning 12 adjacent to the beam 20. The reinforced section 40 is preferably a strip of heavy plasticized canvas material secured to the awning 12. Eyes (not shown) for holding rings 24 may be formed by loops formed in the ends of the reinforced section 40. The awning structure 10 may also be provided with guy ropes 26 to hold the edges of the cover outwardly from the beam 20. The guy ropes 26 may be secured in eyes 28 formed in triangular member 30 of the awning structure 10.

Figure 2:
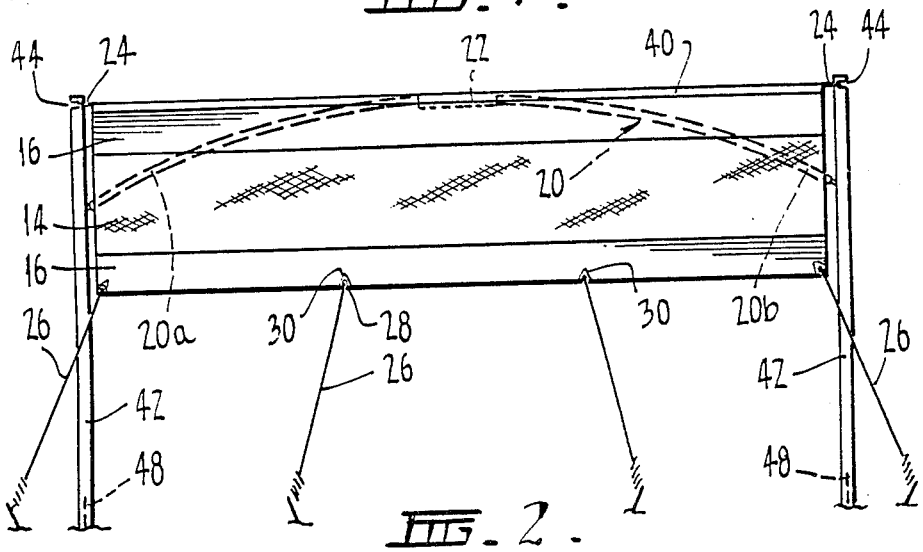
FIG. 2 is a side view of the awning structure of FIG. 1.

Regarding FIG. 2, uprights 42 are provided at each end of the awning structure 10 for supporting the awning structure 10 above the ground and also for placing the awning 12 under tension and the beam 22 under stress as will be discussed with reference to FIGS. 3*a* to 3*c*.

As will be more fully described with reference to FIGS. 4 and 5, the rings 24 are fitted over the uprights 42 and the ends of beam 20 are received in an intermediate portion of the uprights 42.

Turning now to FIGS. 3*a* to 3*c*, the mode of erecting the awning structure will be described.

Firstly, the two sections 20*a* and 20*b* of the beam 20 are connected with joiner 22 beneath the awning 12. The rings 24 (not shown in FIG. 3) are placed over the uprights 42 and the ends of the beam 20 are engaged with the uprights 42.

In the position shown in FIG. 3*a*, the awning 12 is not tensioned and may be supported on the ground whilst the beam 20 is coupled to the uprights 42.

The uprights 42 may then be drawn inwardly in the direction of the arrows D (FIG. 3*b*). This motion commences to distort the beam 20 elastically into a U-shape and at the same time draws the ends of the awning 12 outwardly to tension the awning. Continued movement of the upright 42 into a vertical position (FIG. 3*c*) places the beam under stress and the awning 12 under tension. The uprights 42 may be secured to the ground to hold the awning structure 10 in the position shown in FIG. 3*c*. Since the beam 20 is stressed in a bow and the awning 12 is under tension, the awning structure is very stable.

With reference to FIG. 4, which shows the upright 42 in detail, it can be seen that the upright is formed with a notch 44 for receiving the ring 24 which is secured to the reinforcing material 40 of the awning 12. The upright 42 is also formed with a hole 46 for receiving an end of the beam 20. The upright 42 is preferably hollow so that it can be placed over a tent peg or stud 48 to securely hold the upright in the vertical position shown in FIGS. 2 and 3*c*.

With reference to FIG. 5*a*, the beam 20 preferably has an end piece in the form of a nose 50 connected to each end and held in place by a screw 52. The nose 50 is dimensioned to fit secured in the hole 46 of the upright 42. As shown in FIGS. 5*b* and 6, the sections 20*a* and 20*b* forming beam 20 are connected by joiner 22 which comprises a section of pipe 54 and two cross members 56 which are bolted to the awning 12 and inserted into pipe 54 and held by screws 58. The ends of cross-pieces 54 projecting from the pipe 54 receive the beam section 20*a* and 20*b* which are held in place due to the compression of the beam 20.

FIGS. 7 to 9 show various structures the awning structure may take. The configuration of FIG. 7 is a perspective view of the embodiment of FIGS. 1 and 2.

FIG. 8 shows an extended awning structure with three beams and six supports and FIG. 9 shows an awning structure with two uprights and three beams with poles 60 receiving two of the beams.

FIGS. 10*a* to 10*d* show, in section, a method of joining the SARLON shade mesh 14 to the plasticised canvas 16. Even though the shade mesh 14 is a difficult substance to work with, it is most desirable to use this material since it is porous to wind, resists the rain and also may be heated by the sun. Since it is heated by the sun, the material becomes slightly warmer than its surrounds and causes air to circulate up through the material. Hence, even on hot, still days in the north of Australia, for instance, a cooling draft can be obtained.

Turning to the drawings, the shade mesh 14 has a piece of tape 70 placed along its edge and is cut along the line 72 to obtain a straight edge, (FIG. 10(*b*)). The shade mesh may then be folded over to form a U 76 at its edge. The edge of the canvas 16 may similarly be folded over to form a U 78 at its edge. The two pieces of material may then be intermeshed and double stitched 80 along their length. FIGS. 10*c* and *d* shows the two ways of folding the material i.e. with the mesh 14 on top and the canvas 16 on top.

It is preferred that the awning structure be about 13 meters long and 7.3 meters wide with the joiner 22 being about 1 meter long. However, the awning structure may be made longer or shorter. Indeed, it is proposed that the awning structure be made of sufficient size to cover building sites such as home building sites to provide shade and shelter for workmen.

The awning structure may also be used to provide shade for a swimming pool and other sporting events which may be held in hot and/or wet locations.

The preferred embodiment of the invention provides the advantages that no vertical frames are required in the area covered and the amount of framework is a minimum for the area covered. Hence, clear area is provided beneath the awning structure for roller skating, swimming and other sporting activities. The awning structure is easily transportable and may be quickly erected or dismantled. The size of the structure makes it ideal for holding outdoor meetings for large groups of people in hot weather. Further, the awning structure is easily manufactured.

Still further, and even more importantly, the awning structure, due to the stressing of the beam and the tensioning of the awning is very rigid and can withstand brisk winds and heavy rain. This also makes the awning structure ideal for use in the hot and wet northern area of Australia such as Darwin.

The tensioning of the awning also prevents sag of the awning which would tend to make the awning structure look untidy.

The awning formed from two materials provides desirable air circulation for cooling and good wind resistance. Water is also not able to collect on the awning structure.

Modifications may be made to the invention as would be apparent to persons skilled in the art and such modifications are deemed to be within the scope thereof, the nature of which is to be determined from the foregoing description.

The claims defining the invention are as follows:

1. A method of erecting an awning comprising the steps of connecting a resilient beam at its mid-section to a mid-section of said awning;

connecting the ends of said resilient beam to an intermediate portion of a pair of substantially straight and substantially rigid uprights;

connecting the awning to the tops of said uprights; and forming the beam into a bow configuration by drawing the bottoms of the uprights toward one another as the uprights are brought into an upright position which at the same time stretches the awning outwardly to place the awning under tension.

2. A method of erecting an awning according to claim 1 wherein the uprights are secured to the ground to provide support for the awning.

3. An awning structure comprising:

an awning having two opposite ends;

two substantially straight and substantially rigid uprights, each said upright having an upper and a lower end;

connection means for releasably connecting said opposite ends of said awning to respective said upper ends of said uprights;

a joiner which is secured to the underside of said awning at a location midway between said opposite ends of said awning;

two resiliently flexible beams which are aligned end to end under said awning, the inner ends of said beams being releasably interconnected by said joiner and the outer ends of said beams being releasably connected to respective said uprights at a position intermediate the upper ends and lower ends thereof, said two beams having a joined length which is greater than the length of said awning between said opposite ends such that as said uprights are brought from downwardly and outwardly inclined positions to substantially vertical positions, said beams are caused to bow under compression between respective said uprights and said joiner connected to and vertically supported by said upper ends of said uprights and to vertically support said awning at said joiner only.

4. An awning structure as claimed in claim 3 and further including an additional pair of uprights, an additional connection means, an additional pair of beams and an additional joiner such that said awning is additionally tensioned at a second location.

5. An awning structure as claimed in claim 3 wherein said uprights further include a pair of latterally extending poles having distal ends extending on opposite sides of respective said uprights and said connection means further releasably connects portions of said awning on either side of a respective opposite end to a respective distal end of a respective said pole, and further including two additional joiners located between the respective opposite portions on either side of said opposite ends of said awning and two additional pairs of beams which pairs are interconnected by a respective said additional joiner and which pairs are releasably connected to respective said poles at a position spaced laterally inward from said respective distal ends.

6. An awning according to claim 3 wherein the beams have a projection which is received in a hole in the uprights to secure the ends of the beams to the uprights.

7. An awning according to any one of claim 6 wherein said beams extend substantially along a mid-portion of said awning and the mid-portion of said awning is reinforced by reinforcing material.

8. An awning structure as claimed in claims 3, 7, 4 or 5 and further including a holding means for holding the lower ends of respective said uprights against horizontal movement after said uprights have been moved to the vertical position.

* * * * *